US007334439B2

(12) United States Patent
Ruan

(10) Patent No.: US 7,334,439 B2
(45) Date of Patent: Feb. 26, 2008

(54) ACCESSORY LOCK ASSEMBLY

(75) Inventor: JiaQiang Ruan, Kowloon (HK)

(73) Assignee: Path Line (NG'S) Holding Limited, Kowloon (HK)

( * ) Notice: Subject to any disclaimer, the term of this patent is extended or adjusted under 35 U.S.C. 154(b) by 42 days.

(21) Appl. No.: 10/769,052

(22) Filed: Jan. 30, 2004

(65) Prior Publication Data

US 2005/0166648 A1 Aug. 4, 2005

(51) Int. Cl.
*E05B 13/10* (2006.01)

(52) U.S. Cl. ..... 70/224; 70/370; 70/451; 70/466; 70/488; 292/336.3; 292/337; 292/DIG. 51

(58) Field of Classification Search ..... 70/124–140, 70/117, 141, 488, DIG. 10, 224, 210, 451, 70/419, 452, 142, 448, 416–418, 466, 370; 292/172, 142, 39, 137, 160, 336.3, 337, 346, 292/1.5, DIG. 55, DIG. 51
See application file for complete search history.

(56) References Cited

U.S. PATENT DOCUMENTS 1,661,454 A * 3/1928 Wilson ..... 70/448
2,636,376 A * 4/1953 McConnell ..... 70/151 R
3,992,908 A * 11/1976 Crepinsek ..... 70/370
4,248,068 A * 2/1981 Esser et al. ..... 70/134
4,333,324 A * 6/1982 Dietrich et al. ..... 70/107
4,466,264 A * 8/1984 del Nero ..... 70/417
4,483,162 A * 11/1984 Dunphy et al. ..... 70/134
5,020,343 A * 6/1991 Hart et al. ..... 70/143
5,713,612 A * 2/1998 Kajuch ..... 292/36
6,023,952 A * 2/2000 Mantarakis et al. ..... 70/99
6,128,933 A * 10/2000 Mirshafiee et al. ..... 70/107
6,279,360 B1 * 8/2001 Shen ..... 70/224
6,585,302 B2 * 7/2003 Lin ..... 292/142
6,745,602 B2 * 6/2004 Nakasone et al. ..... 70/224
6,802,546 B2 * 10/2004 Bates et al. ..... 292/358
6,857,297 B1 * 2/2005 Ruan ..... 70/224

* cited by examiner

*Primary Examiner*—Jennifer H. Gay
*Assistant Examiner*—Christopher Boswell
(74) *Attorney, Agent, or Firm*—Raymond Y. Chan; David and Raymond Patent Firm

(57) ABSTRACT

An accessory lock assembly includes a latch assembly, an outer knob assembly mounted on one side of a door panel to connect with the latch assembly, an inner knob assembly mounted on another side of the door panel to connect with the latch assembly, and a lock reinforcing arrangement engaged between the outer and inner knob assemblies to block rotational movements of the outer and inner knob assemblies with the door panel. The inner knob assembly includes an inner actuation unit connecting with the latch assembly and at least a security binding element having a securing end connected to the outer knob assembly and an opposed operating end securely connected to the inner actuation unit within a receiving cavity of a protection shelter in such a manner that the operating end of the connecting element is isolated from outside of the accessory lock assembly by the protection shelter.

2 Claims, 11 Drawing Sheets

ACCESSORY LOCK ASSEMBLY

BACKGROUND OF THE PRESENT INVENTION

1. Field of Invention

The present invention relates to locks, and more particularly to a lock enhancing device which is arranged to reinforce the strength of conventional locks so as to prevent them from being easily damaged, thus failure to provide sound security.

2. Description of Related Arts

A wide variety of locks have been widely used for security purposes. A conventional door lock which is incorporated in a door usually comprises an actuation unit which has a key slot formed therein, a knob assembly comprising an outer protective housing and an inner knob frame attached on an outer and an inner side of a door panel respectively wherein the actuation unit is mounted in the outer protective housing in a rotatably movable manner, and a locking latch mounted between the outer protective housing and the inner knob frame in such a manner that the actuation unit, upon being inserted with a predetermined key, is adapted to drive the locking latch to engage with a door frame by which the door is pivotally supported so that the door panel is locked with respect to the door frame. Conversely, the actuation unit is also adapted to drive the locking latch to disengage with the door frame so that the door panel can be unlocked with respect to the door frame.

As a matter of fact, notwithstanding its popularity, such a conventional door lock has several observable discrepancies. First of all, the very function of the outer protective housing is to protect and strengthen the actuation unit so as to prevent it from being easily damaged or destroyed by an unauthorized trespasser. Unfortunately, very often, the outer protective housing is not strong enough both in terms of the materials used and its structure so that an intentional trespasser, by strongly twisting the actuation unit or vigorously breaking the outer protective housing, can be able to destroy the door lock and open the door. Even though the outer protective housing is not broken altogether by the external force, such a substantial impact may have caused considerable distortion to it which then becomes extremely vulnerable to future damages.

Second, the connection between the outer protective housing and the inner knob frames is usually not strong enough so that when a trespasser applies vigorous impact to the door lock, the connection between the first and the inner knob frame will be broken altogether and, as a result, the outer protective housing and the inner knob frame and the actuation unit may detach from the door and leave the door unlocked immediately.

Moreover, the connection between the outer protective housing and the inner knob frames is usually accomplished by the virtue of a plurality of connecting screws. However, usually, such connecting screws can be screwed from the inner knob frame, such that when the door lock is mounted on a glass door, an intentional trespasser may easily break the glass and then put his/her hands inside the room for screwing out the connecting screws from inside the glass door. As a result, the door lock is easily detached from the glass door, leaving the room unprotected.

Because of the important objective which a door lock has to achieve, governments in various territories have adopted different standards regulating the sales and quality of locks available in that territory. Among those standards and regulations, in United States of America, ANSI/BHMAA156.5-2001 categorizes an anti-twist ability and an impact resistance of a regular door lock as each having three distinct levels, the median of which are 160 Nm and 100 J respectively. As can be seen from these figures, there exist a very high official standard expected from a qualify door lock, and in respect of this, most conventional door locks fail to achieve the required standard.

Because of the inherent structural features of conventional door locks as mentioned above, a stronger and more secure lock is definitely required.

SUMMARY OF THE PRESENT INVENTION

A main object of the present invention is to provide an accessory lock assembly comprising an outer knob assembly and an inner knob assembly the connection of which is substantially protected from unauthorized or unwanted damaged so as to prevent the accessory lock assembly from detaching from a door on which the accessory lock assembly is mounted as a result of the damage.

Another object of the present invention is to provide an accessory lock assembly comprising a lock reinforcing arrangement which is arranged to engage with a door on which the accessory lock assembly is mounted for effectively sharing the strength of the door so as to maximize resistibility upon impacts and excessive twisting.

Another object of the present invention is to provide an accessory lock assembly comprising a lock reinforcing arrangement which comprises a latch guider adapted to transversely bias against the outer knob housing and the inner knob assembly so as to substantially resist a damaging transverse or twisting force applied thereto. Moreover, the latch guider is arranged to engage with the door so as to distribute externally applied forces to the door for strengthening the accessory lock assembly.

Another object of the present invention is to provide an accessory lock assembly comprising at least a security binding element having a securing end connected to said outer knob assembly and an opposed operating end securely connected to an inner actuation unit within a receiving cavity of a protection shelter of the inner knob assembly, such that the operating end of the connecting element is isolated from outside of the accessory lock assembly by the protection shelter.

Another object of the present invention is to provide an accessory lock assembly comprising a lock reinforcing arrangement which does not involve complicated or expensive mechanical components so as to minimize the manufacturing cost and the selling price of the present invention in order that the accessory lock assembly of the present invention can be widely accepted by public, thus increasing their security awareness.

Another object of the present invention is to provide an accessory lock assembly which is capable of substantially complying the highest standard in the field of security locks as prescribed by major orthodox engineering standards or engineering associations, such as the engineering requirements for locks laid down by the International Organization for Standardization (ISO).

Accordingly, in order to accomplish the above objects, the present invention provides an accessory lock assembly for locking a door panel having a lock cavity to a door frame in a pivotally movable manner, comprising:

a latch assembly comprising a latch actuation member adapted for transversely supporting within the lock cavity and a locking latch slidably extended from the latch actuation member between a locked position and an unlocked position, wherein at the locked position, the locking latch is outwardly slid for engaging with the door frame so as to lock up the door panel within the door frame, and at the unlocked position, the locking latch is inwardly slid for receiving in the lock cavity such that the door panel is allowed to be pivotally moved with respect to the door frame;

an outer knob assembly, which is adapted for mounting on an outer side of the door panel, comprising an actuation unit connected to the latch assembly to actuate the locking latch to slidably move between the locked position and the unlocked position;

an inner knob assembly which comprises an inner actuation unit adapted for mounting on an inner side of the door panel to enclose the lock cavity between the inner actuation unit and the outer knob assembly, a protection shelter having a receiving cavity receiving the inner actuation unit therein, and at least a security binding element having a securing end connected to the outer knob assembly and an opposed operating end securely connected to the inner actuation unit within the receiving cavity of the protection shelter in such a manner that the operating end of the connecting element is isolated from outside of the accessory lock assembly by the protection shelter; and a lock reinforcing arrangement substantially supported at the lock cavity, wherein the reinforcing member is engaged with the outer knob assembly so as to block a rotational movement of the outer knob assembly with respect to the lock cavity of the door panel.

These and other objectives, features, and advantages of the present invention will become apparent from the following detailed description, the accompanying drawings, and the appended claims.

DETAILED DESCRIPTION OF THE PREFERRED EMBODIMENT

Figure 1:
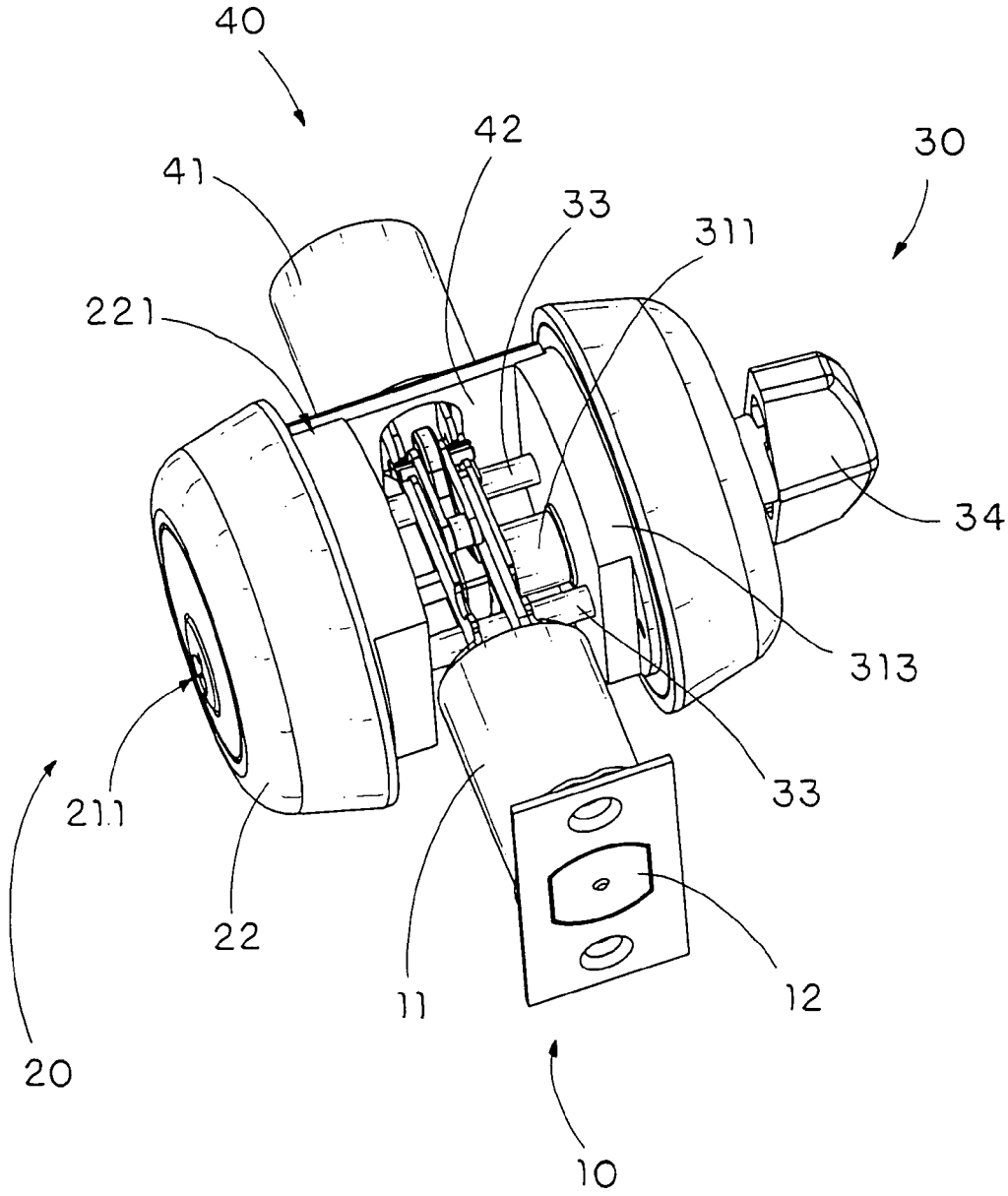
FIG. 1 is a perspective view of an accessory lock assembly according to a preferred embodiment of the present invention.

Referring to FIGS. 1 through 4 of the drawings, an accessory lock assembly according to a preferred embodiment of the present invention is illustrated, wherein the accessory lock assembly is adapted for locking a door panel 1 having a lock cavity 2 to a door frame in a pivotally movable manner.

The accessory lock assembly comprises a latch assembly 10, an outer knob assembly 20, an inner knob assembly 30, and a lock reinforcing arrangement 40.

The latch assembly 10 comprises a latch actuation member 11 adapted for transversely supporting within the lock cavity 2 and a locking latch 12 slidably extended from the latch actuation member 11 between a locked position and an unlocked position, wherein at the locked position, the locking latch 12 is outwardly slid for engaging with the door frame so as to lock up the door panel 1 within the door frame, and at the unlocked position, the locking latch 12 is inwardly slid for receiving in the lock cavity 2 such that the door panel 1 is allowed to be pivotally moved with respect to the door frame.

The outer knob assembly 20, which is adapted for mounting on an outer side of the door panel 1, comprises an outer actuation unit 21 connected to the latch assembly 10 to actuate the locking latch 12 to slidably move between the locked position and the unlocked position.

The inner knob assembly 30 comprises an inner actuation unit 31 adapted for mounting on an inner side of the door panel 1 to enclose the lock cavity 2 between the inner actuation unit 31 and the outer knob assembly 20, a protection shelter 32 having a receiving cavity 321 receiving the inner actuation unit 31 therein, and at least a security binding element 33 having a securing end 331 connected to the outer knob assembly 20 and an opposed operating end 332 securely connected to the inner actuation unit 31 within the receiving cavity 321 of the protection shelter 32 in such a manner that the operating end 332 of the connecting element 33 is isolated from an exterior of the accessory lock assembly by the protection shelter 32.

The lock reinforcing arrangement 40 is substantially supported at the lock cavity 2, wherein the lock reinforcing arrangement 40 is engaged with the outer knob assembly 20 so as to block a rotational movement of the outer knob assembly 20 with respect to the lock cavity 2 of the door panel 1.

According to the preferred embodiment, the outer knob assembly 20 further comprises an outer lock housing 22 to receive the outer actuation unit 21 therein, wherein the outer actuation unit 21 has an outer keyhole 211 for a corresponding key slidably inserting thereinto and an outer actuating arm 212 extended to engage with the latch actuation member 11 to actuate the locking latch 12 between the locked position and the unlocked position with respect to the corresponding key. In other words, when the corresponding key inserts into the outer keyhole 211 of the outer actuation unit 21, the outer actuating arm 212 is allowed to be actuated to actuate the lock latch 12.

Figure 2:
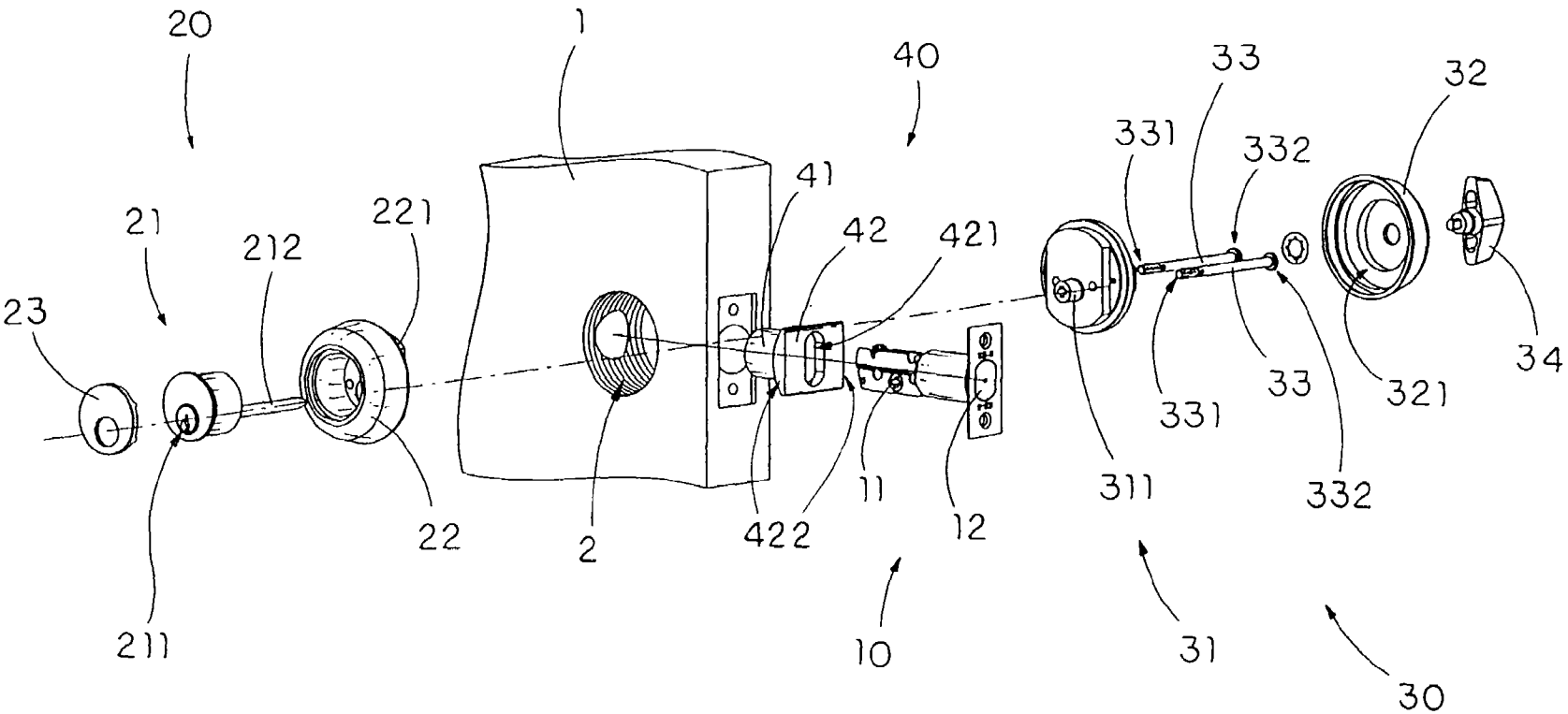
FIG. 2 is an exploded view of the accessory lock assembly according to the above preferred embodiment of the present invention.
Figure 3:
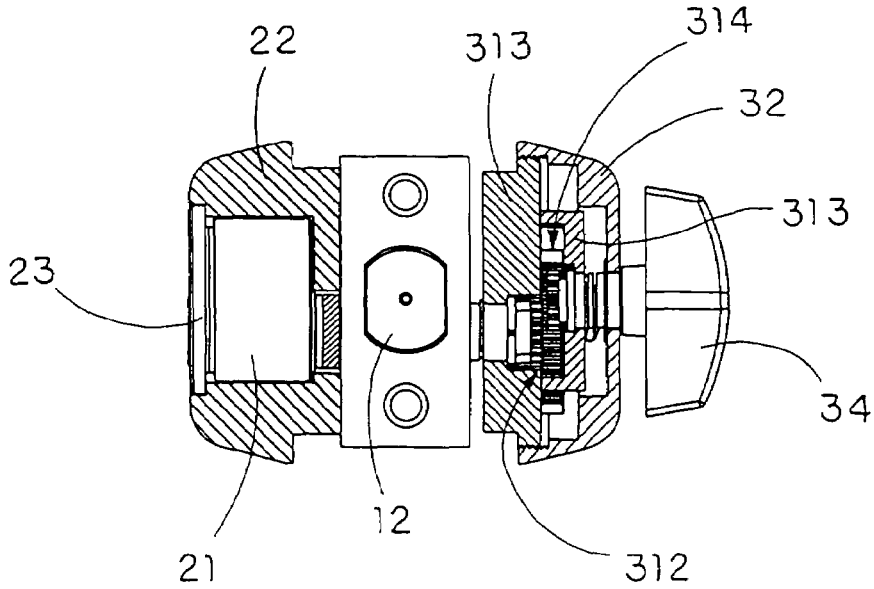
FIG. 3 is a sectional side view of the accessory lock assembly according to the above preferred embodiment of the present invention.
Figure 4:
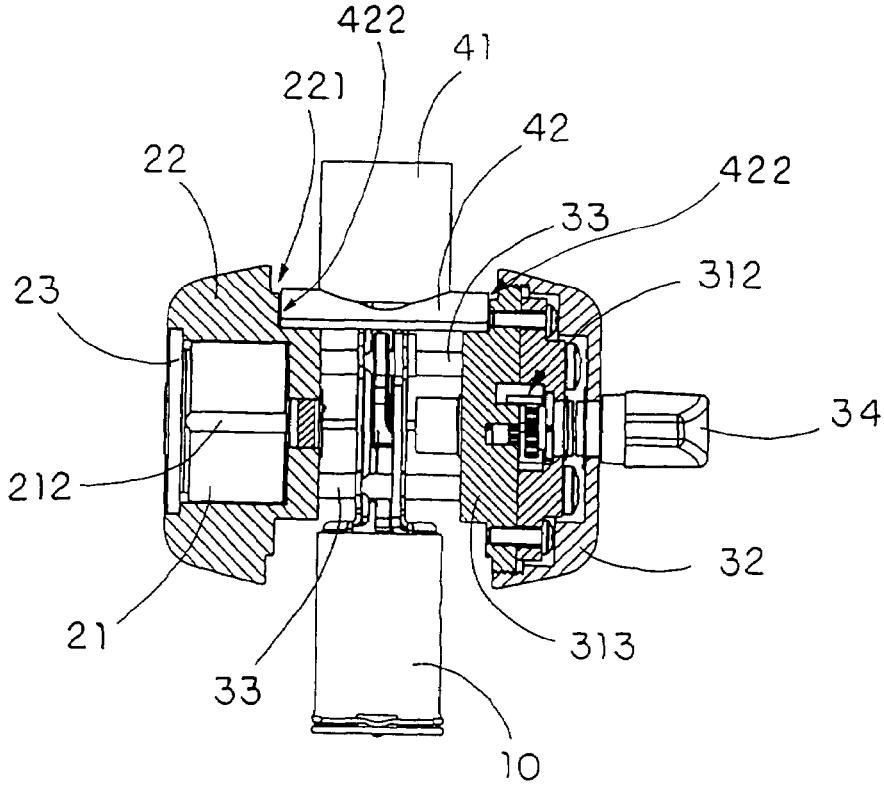
FIG. 4 is a sectional plan view of the accessory lock assembly according to the above preferred embodiment of the present invention.
Figure 5:
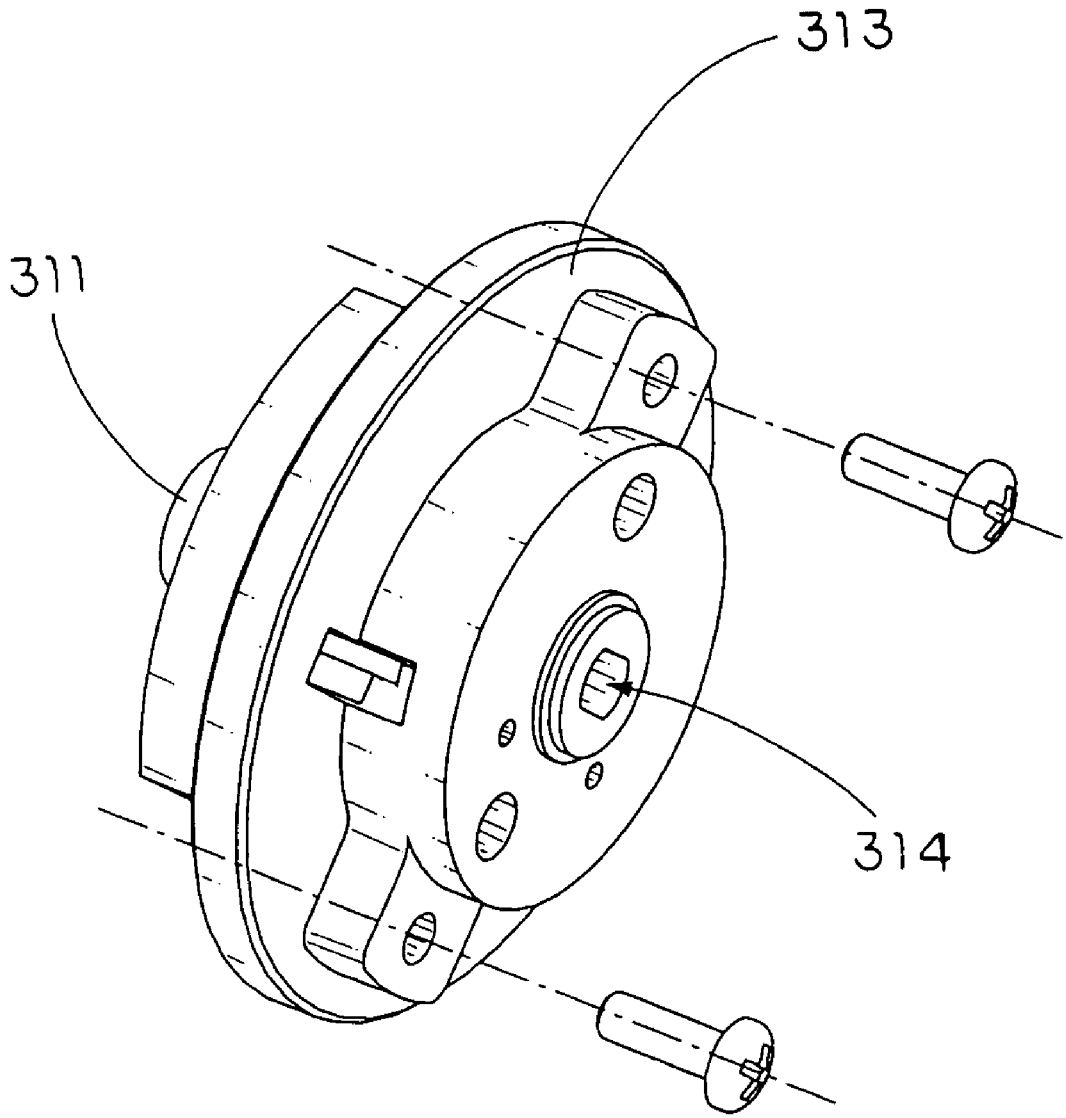
FIG. 5 is a perspective view of the inner actuation unit of the accessory lock assembly according to the above preferred embodiment of the present invention.

As shown in FIGS. 2 and 4, the outer locking housing 22 is arranged for securely mounting on the outer side of the door panel 1 wherein the outer locking housing 22 has a biasing surface 221 extended to a position within the lock cavity 2 to engage with the lock reinforcing arrangement 40 so as to prevent the rotational movement of the outer lock housing 22 with respect to the door panel 1.

It is worth to mention that in order to enhance impact resistibility of the accessory lock assembly, the outer locking housing 22 is thickened to a predetermined thickness such that it is capable of substantially resisting damaging impacts. Customarily, the outer knob assembly 20 may further comprises a front cover 23 mounted on the outer actuation unit 21 for enclosing the outer actuation unit 21 within the outer locking housing 22 so as to provide preliminary protection to the outer actuation unit 21.

As shown in FIG. 2, the security binding element 33 is an elongated screw having a threaded tail as the securing end 331 securely connected to the outer knob assembly 20 and an enlarged head as the operating end 332 engaged with the inner actuation unit 31 so as to substantially sandwich the door panel 1 between the outer knob assembly 20 and the inner actuation unit 31 at the lock cavity 2. It is worth to mention that the operating end 332 of the security binding element 33 is completely isolated from the exterior of the accessory lock assembly by the protection shelter 32 so that a trespasser is unable to damage the inner knob assembly 30 with a view to disassemble the accessory lock assembly by unscrewing the security binding element 33. In other words, the security binding element 33 is simply unreachable by the trespasser.

The inner knob assembly 30 further comprises an operation member 34 rotatably mounted to the inner actuation unit 31 wherein the inner actuation unit 31 comprises an inner actuating axle 311 extended to engage with the latch actuation member 11 to actuate the locking latch 12 and a gear unit 312 operatively connecting the operation member 34 with the inner actuating axle 311 in such a manner that when the operation member 34 is driven to rotate, the inner actuating axle 311 is driven to actuate the locking latch 12 to slidably move between the locked position and the unlocked position through the gear unit 312.

Accordingly, the inner actuating axle 311 is substantially engaged with the outer actuating arm 213 of the outer knob assembly 20 through the latch assembly 10 such that when the corresponding key is inserted into the outer keyhole 211, the corresponding key is adapted to actuate not only the locking latch 12 but also the operation member 34 at the same time. In other words, by either using the corresponding key or actuating the operation member 34, the user is able to lock or unlock the accessory lock assembly of the present invention.

Figure 6:
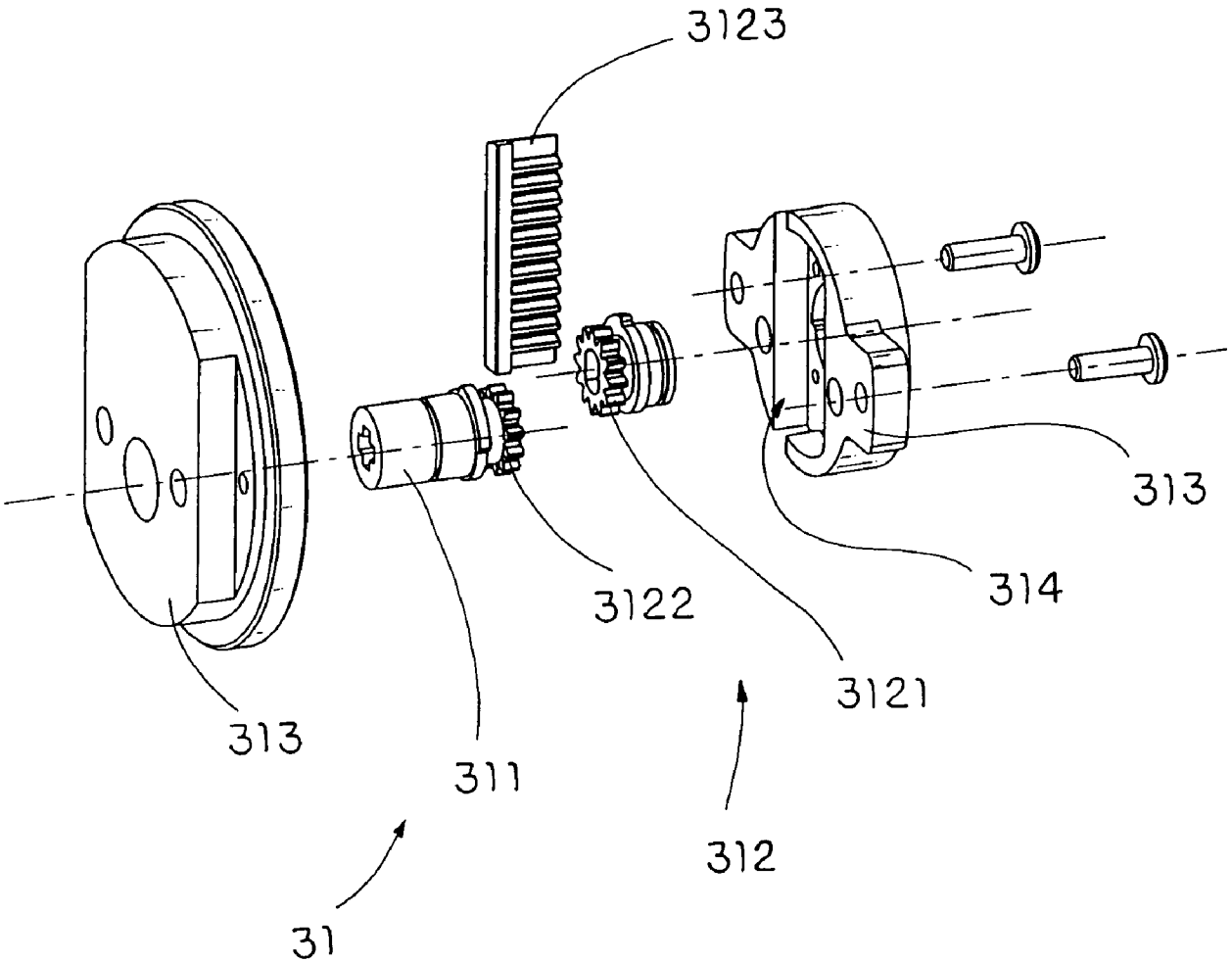
FIG. 6 is an exploded perspective view of the inner actuation unit of the accessory lock assembly according to the above preferred embodiment of the present invention.
Figure 7:
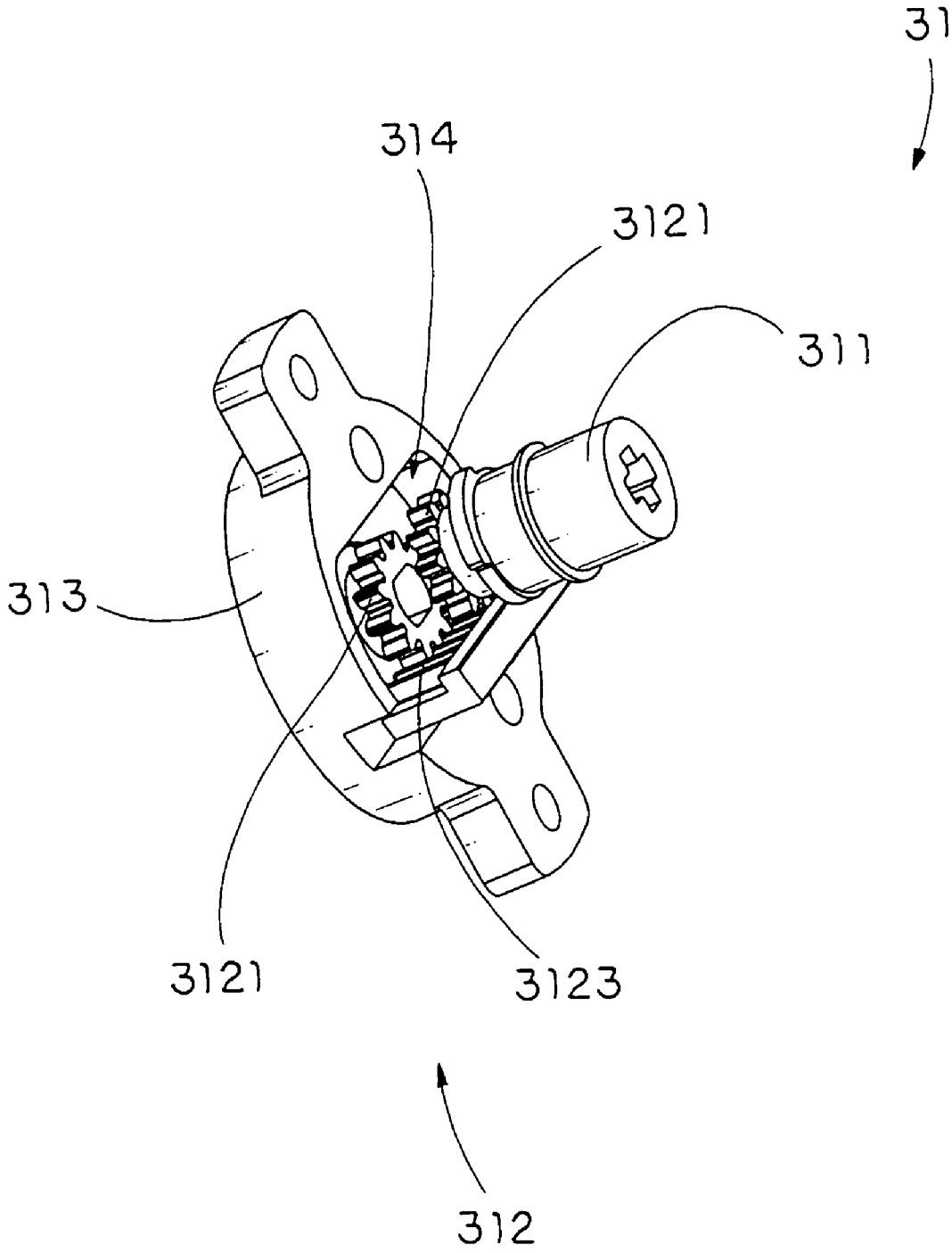
FIG. 7 is a schematic diagram of the inner actuation unit of the accessory lock assembly according to the above preferred embodiment of the present invention.

As shown in FIG. 6, the gear unit 312 comprises a driving gear 3121 mounted on an inner end of the operation member 34, a driven gear 3122 coaxially mounted to the inner actuation axle 311, and a conversion gear 3123 operatively connecting the driving gear 3121 with the driven gear 3122 in such a manner that when the driving gear 3121 is driven to be rotated by the operation member 34, the driven gear 3122 is driven to rotate through the conversion gear 3123 to actuate the locking latch 12 via the inner actuation axle 311.

It is worth to mention that the operation member 34 is configured to directly connect with the inner actuation axle 311 to actuate the locking latch 12 so as to prevent the damage of the inner actuation axle 311 when overmuch rotational force is applied on the operation member 34. In other words, the rotational force of the operation member 34 is transferred to the inner actuation axle 311 through the gear unit 312, the user is able to minimize the force applied on the operation member 34 by the gear ratio of the gear unit 312 so as to enhance the locking and unlocking operations of the inner knob assembly 30.

As shown FIG. 6, the inner actuation unit 31 further comprises a lock casing 313 having a gear cavity 314 to protectively receive the gear unit 312 therein wherein the operation end 332 of the security binding element 33 is securely engaged with the lock casing 313. Accordingly, the lock reinforcing arrangement 40 is engaged with the lock casing 313 of the inner actuation unit 31 so as to prevent the rotational movement of the inner actuation unit 31 with respect to the door panel 1.

The lock reinforcing arrangement 40 comprises a cylindrical reinforcing member 41 arranged to be transversely mounted in the door panel 1 at the lock cavity 2 so as to fittedly and securely engage therewith. The reinforcing member 41 is preferably made of metallic materials having a predetermined strength capable of resisting a substantial amount of torque applied to the outer knob assembly 20. Obviously, the exterior shape of the reinforcing member 41 is not necessarily cylindrical. It can be embodied as a column having a cross sectional shape of a square, rectangle, pentagon, or any other shapes.

Referring to FIG. 2 of the drawings, the locking reinforcing arrangement 40 further comprises a latch guider 42 which is substantially supported within the lock cavity 2 to alignedly engage with an inner end portion of the latch actuation member 11 so as to retain the latch actuation member 11 in position, wherein the latch guider 42 is substantially engaged with the lock housing 313 of the inner actuation unit 31 of the inner knob assembly 30 so as to block up a rotational movement of the inner knob assembly 30 with respect to the lock cavity 2 of the door panel 1.

Moreover, the latch guider 42 is also engaged with the biasing surface 221 of the outer locking housing 22 such that the latch guider 42 is fittedly sandwiched between the front and rear lock assemblies 20, 30, so as to prevent any unwanted rotational movement of the front and rear lock assemblies 20, 30.

As a result, the latch guider 42 further has a coupling slot 421 longitudinally formed on the inner surface thereof wherein the inner end portion of the latch actuation member 11 is coupled with the coupling slot 421 so as to prevent an unwanted movement of the latch actuation member 11 by the latch guider 42.

In other words, the lock reinforcing arrangement 40 is disposed between the outer knob assembly 20 and the inner knob assembly 30, wherein the side surfaces 422 of the guider latch 42 are engaged with the outer locking housing 22 and the lock casing 313, such that the outer knob assembly 20 and the inner knob assembly 30 are substantially retained in position by the guider latch 42 of the locking reinforcing arrangement 40.

When an unusually huge twisting or turning force is applied to the latch assembly 10 with a view to damage the accessory lock assembly, the latch guider 42 along with the reinforcing member 41 will effectively provide a restriction of any damaging movement of the latch actuation member 11 so that it is substantially retained in position and prevented from being vigorously driven to break by excessive force.

It is worth to mention that the latch guider 42 is preferably to be made of strong yet not hard materials so that in discharging its function in preventing excessive movement of the latch actuation member 11, the latch guider 42 will not cause damage to the latch actuation member 11. According to the preferred embodiment, the latch guider 42 should be made of industrial-used plastic materials having a predetermined strength.

Equally remarkable is that the latch guider 42 is preferably to be perpendicularly extended from the reinforcing member 41 so as to maximize a resisting torque provided by reinforcing arrangement 40 when the outer knob assembly 20 and the inner knob assembly 30 are subjected to externally applied twisting or impact. Other inclination is possible, however, according to the preferred embodiment, the inclination angle should be 90 degrees.

FIGS. 8 through 14 illustrate an alternative mode of the inner knob assembly 30' which comprises an inner actuation unit 31' adapted for mounting on a rear side of the door panel 1 to enclose the lock cavity 2 between the inner actuation unit 31' and the outer knob assembly 20.

The inner knob assembly 30' further comprises a protection shelter 32' having receiving cavity 321' receiving the inner actuation unit 31' therein and at least a security binding element 33' having a securing end 331' connected to said outer lock assembly 20 and an opposed operating end 332' securely connected to the inner actuation unit 31' within the receiving cavity 321' of the protection shelter 32' in such a manner that the operating end 332' of the security binding element 33' is isolated from outside of the accessory lock assembly 1 by the protection shelter 32'.

Figure 8:
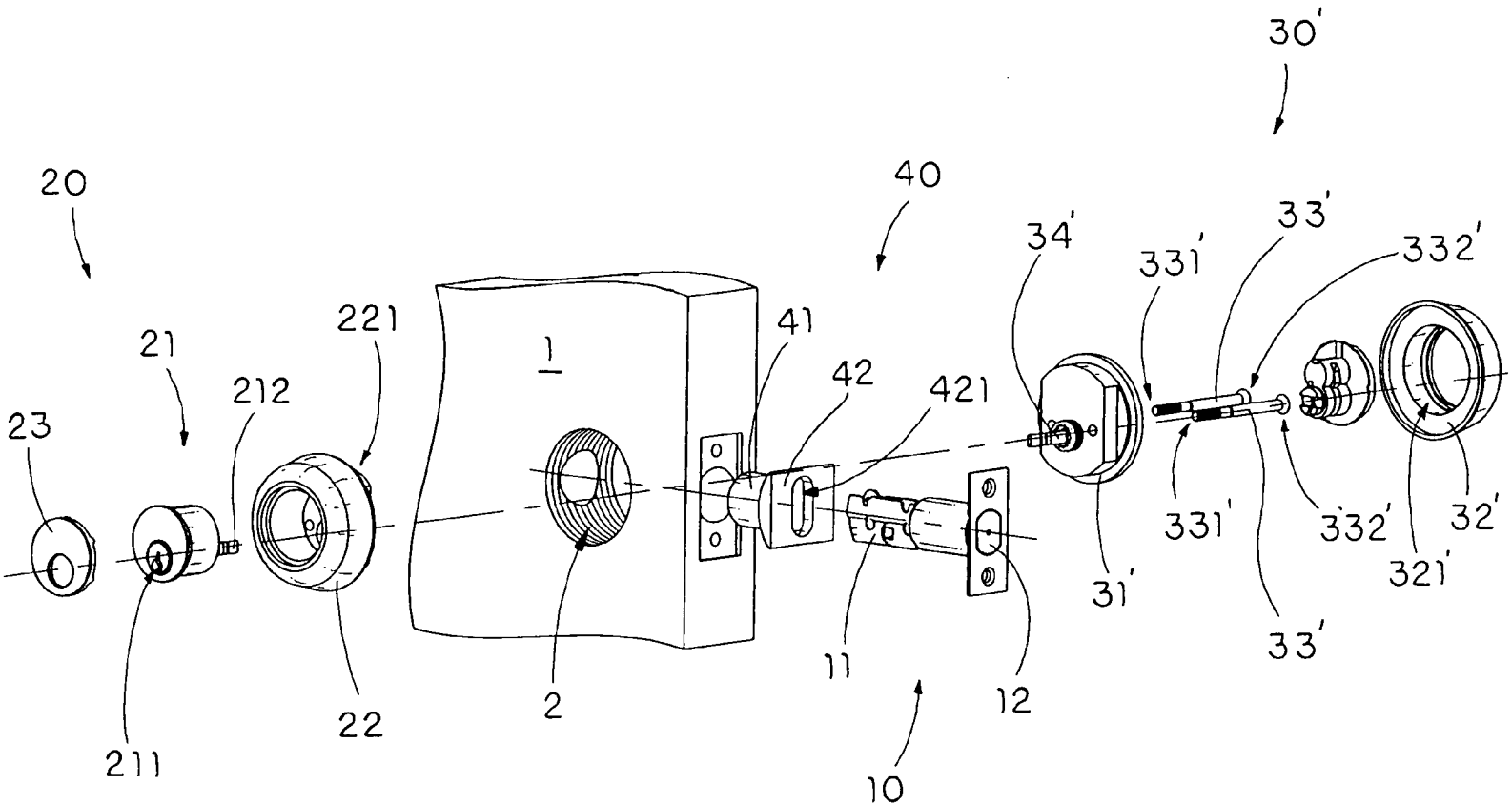
FIG. 8 illustrates an alternative mode of the inner knob assembly of the accessory lock assembly according to its alternative mode of the above preferred embodiment of the present invention.
Figure 10:
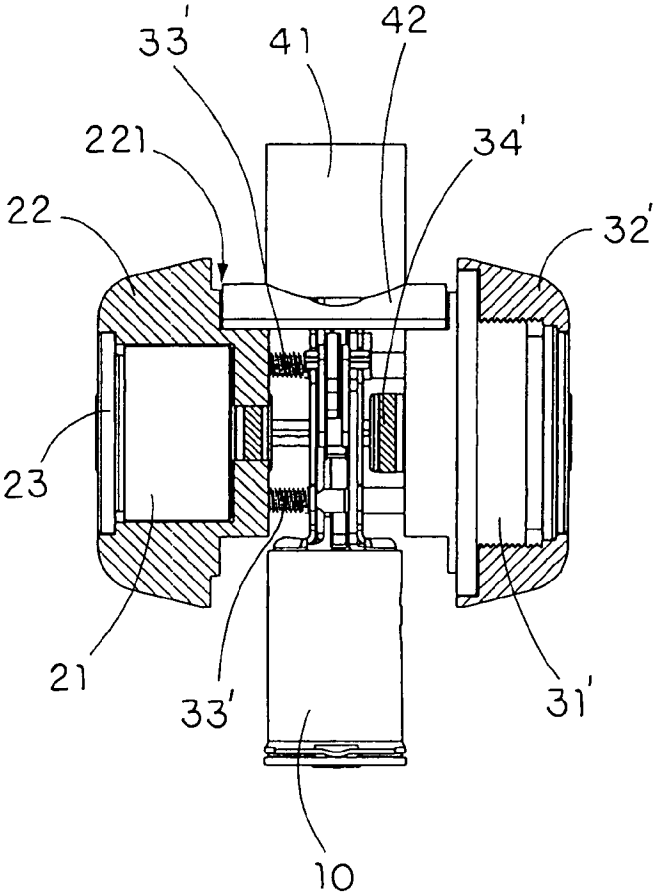
FIG. 10 is a plan view of the accessory lock assembly according to its alternative mode of the above preferred embodiment of the present invention.
Figure 9:
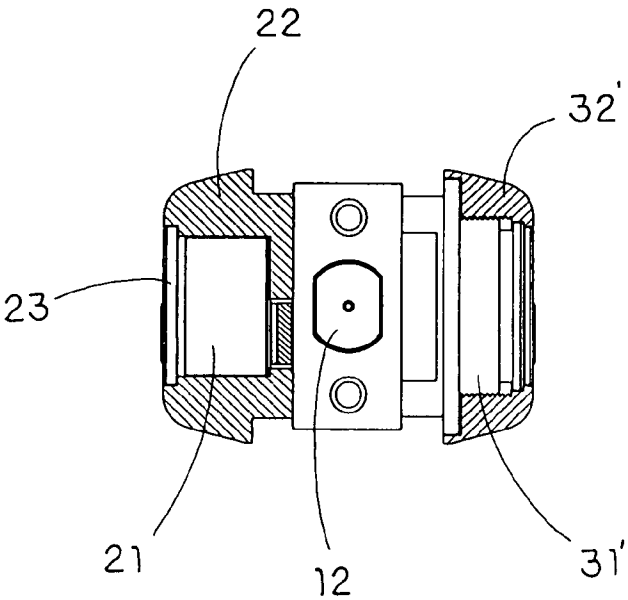
FIG. 9 is a side view of the accessory lock assembly according to its alternative mode of the above preferred embodiment of the present invention.

As shown in FIG. 8, the security binding element 33' is an elongated screw having a threaded tail as the securing end 331' securely connected to the outer knob assembly 20 and an enlarged head as the operating end 332' engaged with the inner actuation unit 31' so as to substantially sandwich the door panel 1 between the outer knob assembly 20 and the inner actuation unit 31' at the lock cavity 2. It is worth to mention that the operating end 332' of the security binding element 33' is completely isolated from the exterior of the accessory lock assembly by the protection shelter 32 so that a trespasser is unable to damage the inner knob assembly 30' with a view to disassemble the accessory lock assembly by unscrewing the security binding element 33'. In other words, the security binding element 33' is simply unreachable by the trespasser.

Accordingly, the inner actuation unit 31' comprises an inner actuation housing 311' defining a lock channel 3111', a detachable rear lock unit 312' slidably mounted in the lock channel 3111' of the inner actuation housing 311' within the receiving cavity 321' of the protection shelter 32' in a detachably attaching manner, and a locker arm 313' mounted to the detachable rear lock unit 312' to lock the detachable rear lock unit 312' with the inner actuation housing 311'.

The inner actuating housing 311' is arranged for mounting on the inner side of the door panel 1 at a position that the latch guider 42 is substantially engaged with the inner actuating housing 311' of the inner actuation unit 31' of the inner knob assembly 30' so as to block up a rotational movement of the inner knob assembly 30' with respect to the lock cavity 2 of the door panel 1.

The lock channel 3111' has an upper circular portion and a lower circular portion to fittingly receive the detachable rear lock unit 312' therein.

The detachable rear lock unit 312' comprises a-core housing 3121' and a lock core 3122' rotatably received in the core housing 3121', wherein the locker arm 313' is radially extended from the lock core 3122' in such a manner that when the lock core 3122' is rotated to drive the locker arm 313' to align within the lock channel 3111', the detachable rear lock unit 312' is allowed to detachably slide out from the inner actuating housing 311'.

Figure 14:
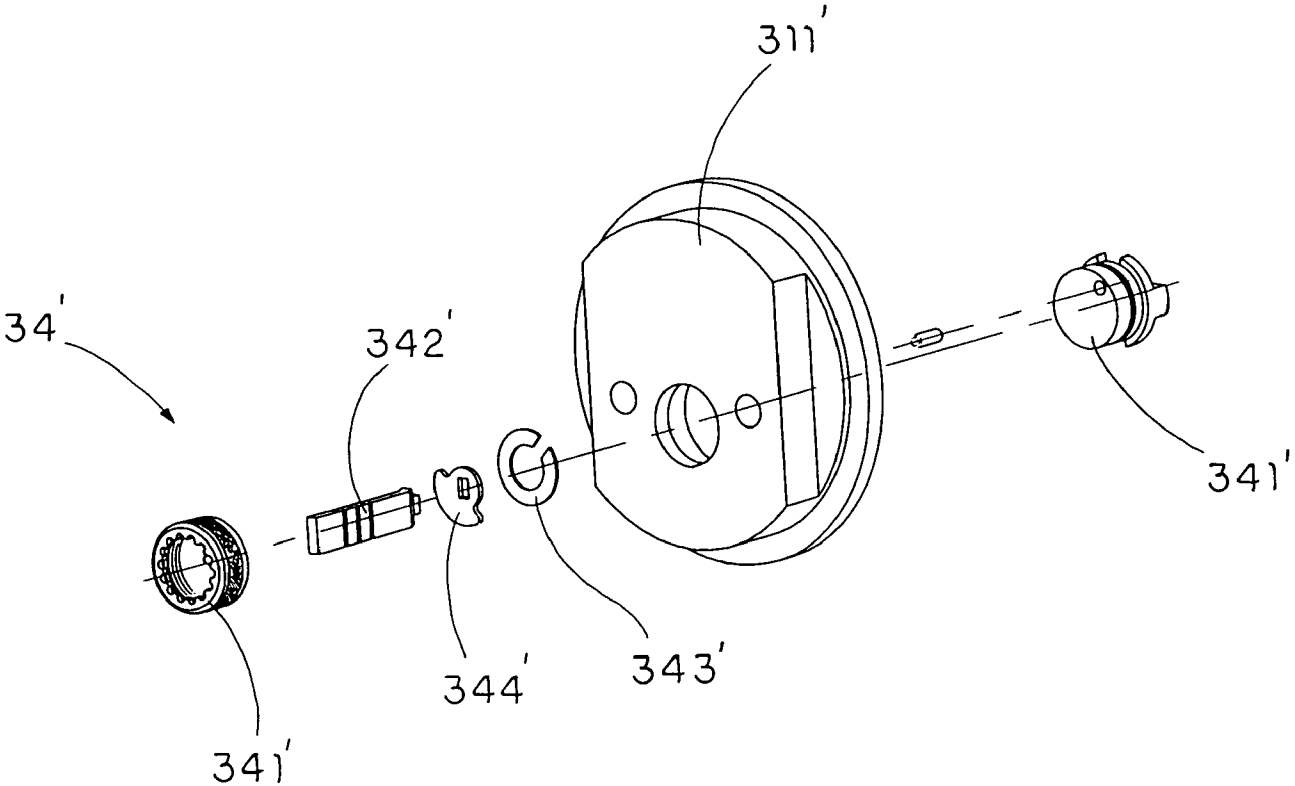
FIG. 14 is an exploded perspective view of an actuation conveying unit of the accessory lock assembly according to its alternative mode of above preferred embodiment of the present invention.

As shown in FIG. 14, the core housing 3121' has a core channel 31211' and a guiding slot 31212' radially extended from the core channel 31211', wherein the lock core 3122' is rotatably disposed in the core channel 31211' while the locker arm 313' is slidably engaged with the guiding slot 31212'.

The lock core 3122' has a tumbler set 31221' to lock up the lock core 3122' within the core channel 31211' in a rotatably movable manner and a key slot 31222' for the corresponding key slidably inserting thereinto to operatively communicate with the tumbler set 31221'. In other words, the corresponding key is slidably inserted into the key slot 31222' to disengage the lock core 3122' with the core housing 3121' such that the lock core 3122' is allowed to be rotated to drive the locker arm 313' to slide along the guiding slot 31212'.

It is worth to mention that the lock core 3122' is positioned at the lower circular portion of the lock channel 3111' such that the lock core 3122' must be rotated at a position that the locker arm 313' is aligned with the upper circular portion of the lock core 3122' in order to detach the detachable rear lock unit 312' from the inner actuating housing 311'.

Figure 11A:
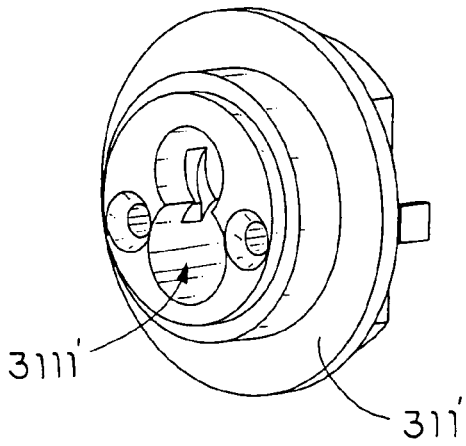
FIG. 11A and FIG. 11B are schematic diagrams of the inner actuation housing of the accessory lock assembly according to its alternative mode of the above preferred embodiment of the present invention.
Figure 11B:
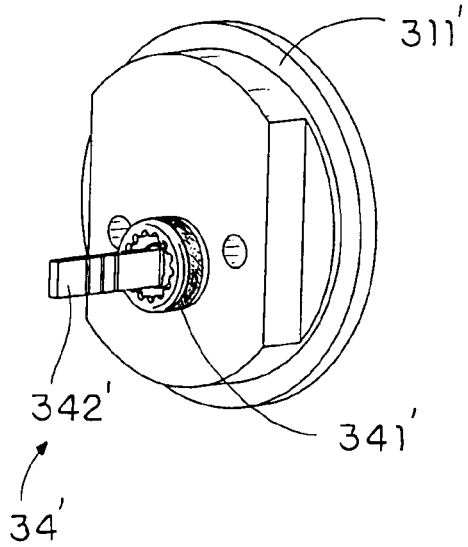
Figure 12A:
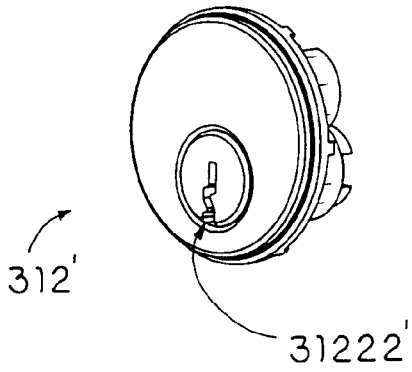
FIG. 12A and FIG. 12B are schematic diagrams of the inner actuation unit of the accessory lock assembly according to its alternative mode of the above preferred embodiment of the present invention.
Figure 12B:
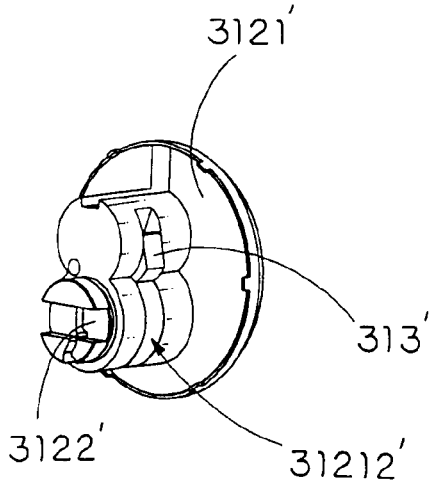
Figure 13:
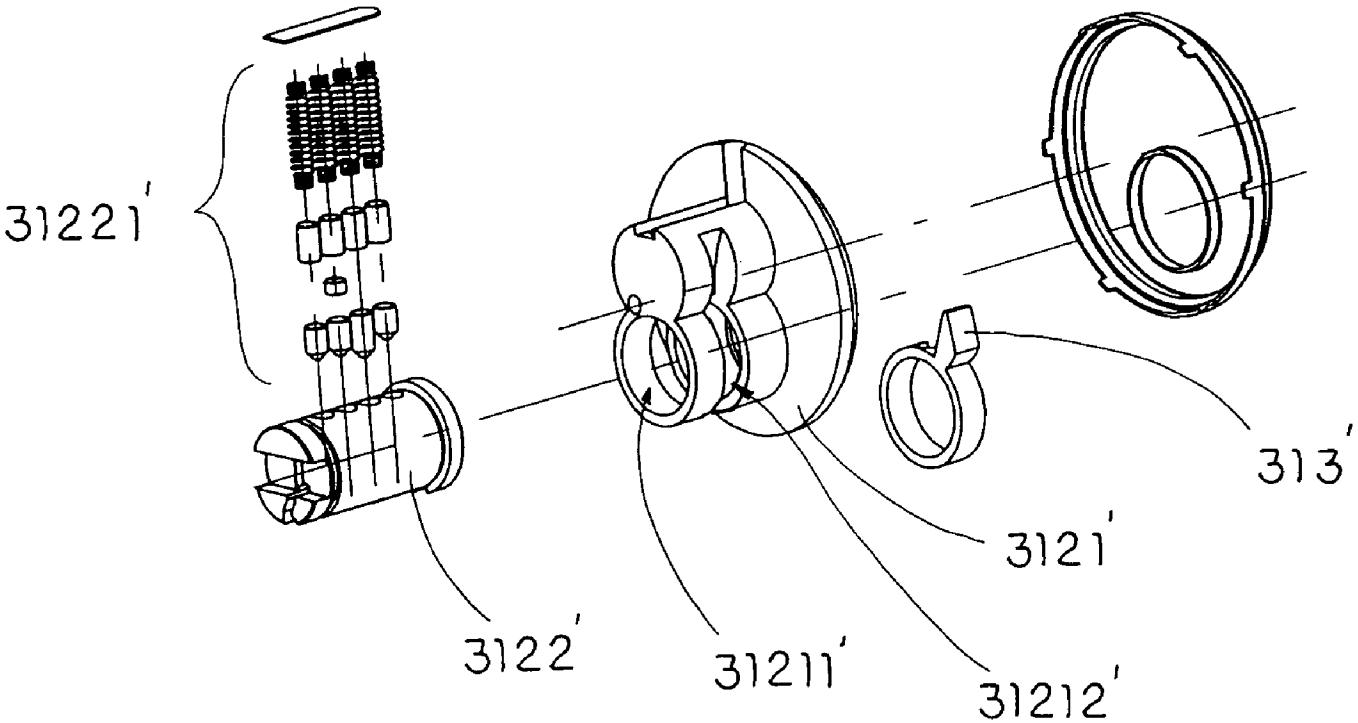
FIG. 13 is an exploded perspective view of a lock replacement arrangement of the accessory lock assembly according to its alternative mode of the above preferred embodiment of the present invention.

As shown in FIGS. 11B and 14, the inner knob assembly 30' further comprises an actuation conveying unit 34' extended from the inner actuation unit 31' to engage with the latch assembly 10.

The actuation conveying unit 34' comprises an actuation connector 341' extended from the lock core 3122' and a conveying arm 342' extended from the actuation connector 341' to engage with the latch actuation member 11 of the latch assembly 10 in such a manner that when the lock core 3122' is rotated, the latch actuation member 11 is actuated through the actuation conveying unit 34' to move the locking latch 12 between the locked position and the unlocked position.

Accordingly, a covering washer 343' is used to connect the actuation connector 341' with the conveying arm 342' via a coupling element 344' such that when the lock core 3122' is driven to rotate, the actuation connector 341' is arranged to transmit the corresponding actuation force to the covering washer 343' which then transmits the actuation force to the actuation assembly 10 through the conveying arm 342'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An accessory lock assembly for locking a door panel, which has a lock cavity, to a door frame, wherein said accessory lock assembly comprises:

a latch assembly comprising a latch actuation member having an inner end portion for transversely supporting within the lock cavity and a locking latch slidably extended from said latch actuation member between a locked position and an unlocked position, wherein at said locked position, said locking latch is outwardly slid for engaging with the door frame so as to lock up the door panel within the door frame, and at said unlocked position, said locking latch is inwardly slid adapted for receiving in the lock cavity such that the door panel is allowed to be moved with respect to the door frame;

an outer knob assembly, which is mounted on an outer side of the door panel, having an inner biasing surface and comprising an outer actuation unit connected to said latch assembly and an outer lock housing receiving said outer actuation unit therein, wherein said outer actuation unit has an outer keyhole for a corresponding key slidably inserting thereinto and an outer actuating arm extended to engage with said latch actuation member to actuate said locking latch between said locked position and said unlocked position with respect to said corresponding key such that when said corresponding key is inserted into said outer keyhole of said outer actuation unit, said outer actuating arm is allowed to be actuated to actuate said lock latch, wherein said inner biasing surface of said outer knob assembly is formed at said outer lock housing, wherein when said outer knob assembly is mounted on said outer side of the door panel, said inner biasing surface thereof is facing towards an inner side of the door panel;

an inner knob assembly, which is mounted on said inner side of the door panel, having an inner side surface facing towards said inner biasing surface of said outer knob assembly when said inner knob assembly is mounted on said inner side of the door panel, wherein said inner knob assembly comprises an inner actuation unit connected to said latch assembly to actuate said locking latch to slidably move between said locked position and said unlocked position, a protection shelter having a receiving cavity receiving said inner actuation unit therein, and at least a security binding element having a securing end connected to said outer knob assembly and an opposed operating end securely connected to said inner actuation unit within said receiving cavity of said protection shelter in such a manner that said operating end of said security binding element is isolated from outside of said accessory lock assembly by said protection shelter, wherein said inner knob assembly further comprises an operation member rotatably mounted to said inner actuation unit, wherein said inner actuation unit comprises an inner actuating axle extended to engage with said latch actuation member to actuate said locking latch and a gear unit operatively connecting said operation member with said inner actuating axle in such a manner that when said operation member is driven to rotate, said inner actuating axle is driven to actuate said locking latch to slidably move between said locked position and said unlocked position through said gear unit, so as to minimize a rotational force applied to said latch actuation member from said operation member; and a lock reinforcing arrangement, which reinforces said inner and outer knob assemblies through the door panel, comprising a reinforcing member securely embedding in the door panel and a latch guider integrally and perpendicularly extended from said reinforcing member at a position within said lock cavity such that said latch guider is substantially supported within said lock cavity when said reinforcing member is secured at the door panel, wherein said latch guider has a coupling slot longitudinally formed thereon, wherein said inner end portion of said latch actuation member is coupled with said coupling slot so as to prevent an unwanted movement of said latch actuation member, wherein said latch guider has a width corresponding to a distance between said inner biasing surface of said outer knob assembly and said inner side surface of said inner knob assembly when said outer knob assembly and said inner knob assembly are mounted at said outer and inner sides of the door panel respectively, wherein said latch guider further has two side engaging surfaces that one of said side engaging surfaces is substantially biasing against said inner biasing surface of said outer knob assembly and another said side engaging surface is substantially biasing against said inner side surface of said inner knob assembly, wherein said latch guider is securely sandwiched between said inner and outer knob assemblies via said security binding element, wherein said inner and outer knob assemblies are locked up with respect to the door panel in a rotational manner within said lock cavity via said lock reinforcing arrangement while said latch guider is retained within said lock cavity via said reinforcing member locking at the door panel, such that said inner and outer knob assemblies are substantially retained in position for preventing a rotational movement of each of said inner and outer knob assemblies with respect to the lock cavity of the door panel, wherein said gear unit comprises a driving gear mounted on an inner end of said operation member, a driven gear coaxially mounted to said inner actuation axle, and a conversion gear operatively connecting said driving gear with said driven gear in such a manner that when said driving gear is driven to be rotated by said operation member, said driven gear is driven to rotate through said conversion gear to actuate said locking latch via said inner actuation axle.

2. An accessory lock assembly for locking a door panel, which has a lock cavity, to a door frame, wherein said accessory lock assembly comprises:

a latch assembly comprising a latch actuation member having an inner end portion for transversely supporting within the lock cavity and a locking latch slidably extended from said latch actuation member between a locked position and an unlocked position, wherein at said locked position, said locking latch is outwardly slid for engaging with the door frame so as to lock up the door panel within the door frame, and at said unlocked position, said locking latch is inwardly slid adapted for receiving in the lock cavity such that the door panel is allowed to be moved with respect to the door frame;

an outer knob assembly, which is mounted on an outer side of the door panel, having an inner biasing surface and comprising an outer actuation unit connected to said latch assembly and an outer lock housing receiving said outer actuation unit therein, wherein said outer actuation unit has an outer keyhole for a corresponding key slidably inserting thereinto and an outer actuating arm extended to engage with said latch actuation member to actuate said locking latch between said locked position and said unlocked position with respect to said corresponding key such that when said corresponding key is inserted into said outer keyhole of said outer actuation unit, said outer actuating arm is allowed to be actuated to actuate said lock latch, wherein said inner biasing surface of said outer knob assembly is formed at said outer lock housing, wherein when said outer knob assembly is mounted on said outer side of the door panel, said inner biasing surface thereof is facing towards an inner side of the door panel;

an inner knob assembly, which is mounted on said inner side of the door panel, having an inner side surface facing towards said inner biasing surface of said outer knob assembly when said inner knob assembly is mounted on said inner side of the door panel, wherein said inner knob assembly comprises an inner actuation unit connected to said latch assembly to actuate said locking latch to slidably move between said locked position and said unlocked position, a protection shelter having a receiving cavity receiving said inner actuation unit therein, and at least a security binding element having a securing end connected to said outer knob assembly and an opposed operating end securely connected to said inner actuation unit within said receiving cavity of said protection shelter in such a manner that said operating end of said security binding element is isolated from outside of said accessory lock assembly by said protection shelter, wherein said inner knob assembly further comprises an operation member rotatably mounted to said inner actuation unit, wherein said inner actuation unit comprises an inner actuating axle extended to engage with said latch actuation member to actuate said locking latch and a gear unit operatively connecting said operation member with said inner actuating axle in such a manner that when said operation member is driven to rotate, said inner actuating axle is driven to actuate said locking latch to slidably move between said locked position and said unlocked position through said gear unit, so as to minimize a rotational force applied to said latch actuation member from said operation member; and a lock reinforcing arrangement, which reinforces said inner and outer knob assemblies through the door panel, comprising a reinforcing member securely embedding in the door panel and a latch guider integrally and perpendicularly extended from said reinforcing member at a position within said lock cavity such that said latch guider is substantially supported within said lock cavity when said reinforcing member is secured at the door panel, wherein said latch guider has a coupling slot longitudinally formed thereon, wherein said inner end portion of said latch actuation member is coupled with said coupling slot so as to prevent an unwanted movement of said latch actuation member, wherein said latch guider has a width corresponding to a distance between said inner biasing surface of said outer knob assembly and said inner side surface of said inner knob assembly when said outer knob assembly and said inner knob assembly are mounted at said outer and inner sides of the door panel respectively, wherein said latch guider further has two side engaging surfaces that one of said side engaging surfaces is substantially biasing against said inner biasing surface of said outer knob assembly and another said side engaging surface is substantially biasing against said inner side surface of said inner knob assembly, wherein said latch guider is securely sandwiched between said inner and outer knob assemblies via said security binding element, wherein said inner and outer knob assemblies are locked up with respect to the door panel in a rotational manner within said lock cavity via said lock reinforcing arrangement while said latch guider is retained within said lock cavity via said reinforcing member locking at the door panel, such that said inner and outer knob assemblies are substantially retained in position for preventing a rotational movement of each of said inner and outer knob assemblies with respect to the lock cavity of the door panel, wherein said security binding element is an elongated screw having a threaded tail as said securing end securely connected to said outer knob assembly and an enlarged head as said operating end engaged with said inner actuation unit, wherein said operation end of said security binding element is enclosed within said receiving cavity so as to protect by said protection shelter, wherein said security binding element couples said outer knob assembly with said inner knob assembly to ensure said latch guider being sandwiched between said inner and outer knob assemblies and to ensure said two side engaging surfaces of said latch guider biasing against said inner biasing surface of said outer knob assembly and said inner side surface of said inner knob assembly, and wherein said gear unit comprises a driving gear mounted on an inner end of said operation member, a driven gear coaxially mounted to said inner actuation axle, and a conversion gear operatively connecting said driving gear with said driven gear in such a manner that when said driving gear is driven to be rotated by said operation member, said driven gear is driven to rotate through said conversion gear to actuate said locking latch via said inner actuation axle.

* * * * *